US010249235B2

(12) United States Patent
Yamaji

(10) Patent No.: US 10,249,235 B2
(45) Date of Patent: Apr. 2, 2019

(54) TIMING CONTROLLER, ELECTRONIC APPARATUS USING THE SAME, IMAGE DATA PROCESSING METHOD

(71) Applicant: ROHM CO., LTD., Ukyo-Ku, Kyoto (JP)

(72) Inventor: Hideo Yamaji, Kyoto (JP)

(73) Assignee: ROHM CO. LTD., Kyoto (JP)

( * ) Notice: Subject to any disclaimer, the term of this patent is extended or adjusted under 35 U.S.C. 154(b) by 156 days.

(21) Appl. No.: 15/188,331

(22) Filed: Jun. 21, 2016

(65) Prior Publication Data

US 2016/0379559 A1 Dec. 29, 2016

(30) Foreign Application Priority Data

Jun. 23, 2015 (JP) ..... 2015-125800

(51) Int. Cl.

| | |
|---|---|
| ***G09G 3/20*** | (2006.01) |
| ***G09G 3/36*** | (2006.01) |
| ***G09G 5/00*** | (2006.01) |
| ***G09G 5/391*** | (2006.01) |

(52) U.S. Cl.

CPC ..... *G09G 3/2096* (2013.01); *G09G 3/3666* (2013.01); *G09G 5/008* (2013.01); *G09G 5/391* (2013.01); *G09G 2310/08* (2013.01); *G09G 2340/0435* (2013.01)

(58) Field of Classification Search

CPC .... G09G 3/2096; G09G 3/3666; G09G 5/008; G09G 5/391; G09G 2310/08; G09G 2340/0435

See application file for complete search history.

(56) References Cited

U.S. PATENT DOCUMENTS

2007/0097263 A1* 5/2007 Kim ..... G09G 5/005 348/521
2009/0174691 A1* 7/2009 Yeo ..... G09G 3/2096 345/204
2012/0146968 A1* 6/2012 Glen ..... G09G 5/003 345/204
2016/0203802 A1* 7/2016 Hong ..... G09G 5/006 345/534

FOREIGN PATENT DOCUMENTS

JP 2000078027 A 3/2000
JP 2007096903 A 4/2007

* cited by examiner

*Primary Examiner* — Sahlu Okebato
(74) *Attorney, Agent, or Firm* — Cantor Colburn LLP

(57) ABSTRACT

A timing controller may reduce power consumption and/or reduce influence on wireless communication. A line memory is capable of retaining at least pixel data of one line. An input interface circuit is used for receiving pixel data and storing the pixel data in the line memory. A frequency synthesizer is used for receiving the external pixel clock $CK_P$ received by the input interface circuit and generating an internal pixel clock $CK_{INT}$ having frequency being a coefficient K multiplied by frequency of the external pixel clock $CK_P$. An image processing circuit is used for processing the pixel data stored in the line memory synchronously with the internal pixel clock $CK_{INT}$.

16 Claims, 10 Drawing Sheets

TIMING CONTROLLER, ELECTRONIC APPARATUS USING THE SAME, IMAGE DATA PROCESSING METHOD

CROSS REFERENCE TO PRIOR APPLICATION

The present invention claims priority under 35 U.S.C. § 119 to Japanese Application No. 2015-125800 filed Jun. 23, 2015, the entire content of which is incorporated herein by reference.

BACKGROUND

The present invention is related to a timing controller for receiving image data from a graphic controller and outputting information to a gate driver and a source driver.

FIG. 1 is a block diagram showing an image display system. The image display system 100 includes a display panel 102 such as a liquid crystal panel or an organic electroluminescent (EL) panel, a gate driver 104, a source driver 106, a graphic controller 110 and a timing controller 200. The graphic controller 110 generates image data to be displayed on the display panel 102. The pixel (Red Green blue, RGB) data included in the image date are transmitted in a serial format to the timing controller 200. Cables can be detachably connected to a connector 112.

The timing controller 200 receives the image data and generates various control signals and timing signals (synchronization signals). The gate timing signal is transmitted to the gate driver 104. The gate driver 104 selects scanning lines Ls of the display panel 102 in order synchronously with the gate timing signal. In addition, the RGB data are provided to the source driver 106, and the data line $L_D$ for outputting the RGB data is driven by the source driver 106.

FIG. 2 is a block diagram showing the timing controller 200*r* in FIG. 1. The timing controller 200*r* includes an input interface circuit 202, an image processing circuit 204, a clock tree 206 and an output interface circuit 208. The graphic controller 110 receives the RGB data serially transmitted from the input interface circuit 202. The RGB data are transmitted synchronously with the pixel clock $CK_P$. The RGB data can be transmitted through a clock line, and can also be embedded in the RGB data. The pixel clock $CK_P$ is provided to the image processing circuit 204 and the output interface circuit 208 through the clock tree 206. The clock tree 206 includes a clock buffer or a gating circuit and respectively allocates the pixel clock $CK_P$ to the image processing circuit 204 and output interface circuit 208 with the proper timing.

The image processing circuit 204 receives the RGB data (pixel data) and performs the necessary signal processing. The RGB data receiving the signal processing are transmitted to the source driver 106 through the output interface circuit (transmitter) 208.

BACKGROUND TECHNICAL LITERATURES

Patent Literatures

[Patent literature 1] Japanese Patent Application Publication No. 2000-78027

[Patent literature 2] Japanese Patent Application Publication No. 2007-96903

BRIEF SUMMARY OF THE INVENTION

Problems to be Solved

With the increase of the resolution of the image data, the frequency of the pixel clock $CK_P$ trends to increase. In order to perform signal processing by the image processing circuit 204 in synchronization with the pixel clock $CK_P$, the power consumption of the image processing circuit 204 increases along with the increased frequency of the pixel clock $CK_P$. Further, it also consumes power when the pixel clock $CK_P$ is transmitted to the clock tree 206.

From another point of view, the timing controller 200*r* radiates noise having the frequency like that of the pixel clock $CK_P$ by synchronous actions of the image processing circuit 204 or the clock tree 206 with the pixel clock $CK_P$. Also, the worrying thing is that the noise causes adverse influence to external wireless communication.

The present invention is completed based on the above situations, and one of the exemplary purposes is to provide a timing controller, which reduces the power consumption and/or reduces the influence to wireless communication.

Technical Means for Solving Problems

An embodiment of the present invention is related to a timing controller. The timing controller is configured to receive pixel data constituting image data and an external pixel clock accompanying with the pixel data from a graphic controller and output to a data driver. The timing controller includes a line memory, capable of retaining at least pixel data of one line, an input interface circuit, for receiving the pixel data and storing the pixel data in the line memory, a frequency synthesizer, for receiving the external pixel clock received by the input interface circuit and generating an internal pixel clock having a frequency being a coefficient K (K is a real number) multiplied by a frequency of the external pixel clock, an image processing circuit, for processing the pixel data stored in the line memory synchronously with the internal pixel clock and an output interface circuit, for transmitting the pixel data processed by the image processing circuit to a source driver synchronously with the internal pixel clock.

If the coefficient K is determined to be less than 1, the frequency of the internal pixel clock becomes low. By reducing the pixel number of the horizontal blank duration, the pixel data of one line can be processed without failure. If the coefficient K is determined to be more than 1, the frequency of the internal pixel clock becomes high. In this situation, by increasing the pixel number of the horizontal blank duration, the pixel data of one line can be processed without failure. In other words, by adjusting the pixel number of the horizontal blank duration, the frequency of the internal pixel clock can be freely set. As a result, the power consumption of the timing controller can be reduced and/or the influence on wireless communication can be reduced.

It may also be that $f_{PIX}$ is a frequency (Hz) of the external pixel clock and $T_{LINE}$ is a transmission time (s) for pixel data of one line, wherein the coefficient K satisfies equation (1).

$$T_{LINE} > H_{ACT}/(f_{PIX} \times K) \quad (1)$$

Therefore, the pixel number of the horizontal blank duration can be properly reduced to maintain the processing time of one line in the horizontal direction. Further, the power consumption of the timing controller can be reduced by reducing the frequency of the internal pixel clock.

It may also be that $H_{ACT}$ is a horizontal resolution of an active area of the image data and $H_{TOTAL}$ is a horizontal resolution including a blank area of the image data, wherein the coefficient K satisfies equation (2).

$$H_{ACT}/H_{TOTAL} < K \quad (2)$$

It may also be that $f_{PIX}$ is a frequency (Hz) of the external pixel clock, $f_R$ is a refresh rate (Hz) of the image data, $V_{TOTAL}$ is a vertical resolution including a blank area and $H_{ACT}$ is a horizontal resolution of an active area, wherein the coefficient K satisfies equation (3).

$$(1/f_R)/V_{TOTAL}>H_{ACT}/(f_{PIX}\times K) \quad (3)$$

It may also be that the graphic controller is capable of changing the refresh rate of the image data, and the coefficient K is determined for each refresh rate.

The timing controller can further include a detector for detecting the refresh rate.

In an embodiment, the timing controller can further include a frequency controller for dynamically controlling the coefficient K according to a status of the image data and/or a status of an apparatus carrying the timing controller.

It may also be K>1. The coefficient K can also be determined so that $f_{PIX}\times K$ is inconsistent with a frequency spectrum for wireless communication.

The frequency synthesizer can also include a fractional PLL (phase locked loop) circuit. Accordingly, the coefficient K can be finely set.

The frequency division ratio of the fractional PLL circuit can be variable. As a result, the coefficient K is variable.

The timing controller can also be integrated on a semiconductor substrate.

The term "integrated" includes a situation that essential elements constituting the circuit are all formed on a semiconductor substrate and a situation that the main essential elements constituting the circuit are integrated. It may also be that a part of resistors or capacitors are disposed outside a semiconductor substrate for adjusting circuit constants.

Another embodiment is related to an electronic apparatus. The electronic apparatus includes any one of the timing controller described above.

Another embodiment of the present invention is also related to a timing controller. The timing controller includes a frame memory capable of retaining the pixel data of one frame, an input interface circuit for receiving the pixel data and storing the pixel data in the frame memory, a frequency synthesizer for receiving the outside pixel clock received by the input interface circuit and generating an internal pixel clock having a frequency being a coefficient K multiplied by a frequency of the external pixel clock, an image processing circuit for processing the pixel date stored in the frame memory synchronously with the internal pixel clock and an output interface circuit for transmitting the pixel data processed by the image processing circuit to a source driver synchronously with the internal pixel clock. In this embodiment, $f_{PIX}$ is a frequency (Hz) of the external pixel clock, $f_R$ is a refresh rate (Hz) of the image data, $H_{TOTAL}$ is a horizontal resolution including a blank area and $V_{ACT}$ is a vertical resolution of an active area, wherein K<1 satisfies $(1/f_R)/H_{TOTAL}>V_{ACT}/(f_{PIX}\times K)$.

The pixel number of the vertical blank duration is properly reduced to maintain the processing time for one longitudinal column, such that the frequency of the internal pixel clock can be reduced, and the power consumption can be reduced.

Another embodiment of the present invention is also related to a timing controller. The timing controller includes a frame memory capable of retaining the pixel data of one frame, an input interface circuit for receiving pixel data and storing the pixel data in the frame memory, a frequency synthesizer for receiving an external pixel clock received by the input interface circuit and generating an internal pixel clock having a frequency being a coefficient K multiplied by a frequency of the external pixel clock, an image processing circuit for processing the pixel date stored in the frame memory synchronously with the internal pixel clock and an output interface circuit for transmitting the pixel data processed by the image processing circuit to a source driver synchronously with the internal pixel clock. In this embodiment, $f_{PIX}$ is a frequency (Hz) of the external pixel clock, $f_R$ (Hz) is a refresh rate (Hz) of the image data, $H_{ACT}$ is a horizontal resolution of an active area and $V_{ACT}$ is a vertical resolution of an active area, wherein K<1 satisfies $(1/f_R)/(H_{ACT}\times V_{ACT})>1/(f_{PIX}\times K)$.

The pixel number of the vertical blank duration and the horizontal blank duration is properly reduced to maintain the processing time for one frame, such that the frequency of the internal pixel clock can be reduced, and the power consumption can be reduced.

In addition, the invention formed by any combination of the above essential elements or the invention obtained from conversions between the methods and devices of the present invention are also included in the present invention.

Effects of the Present Invention

According to an embodiment of the present invention, the power consumption can be reduced and/or the influence on the wireless communication can be reduced.

DETAILED DESCRIPTION

Figure 1:
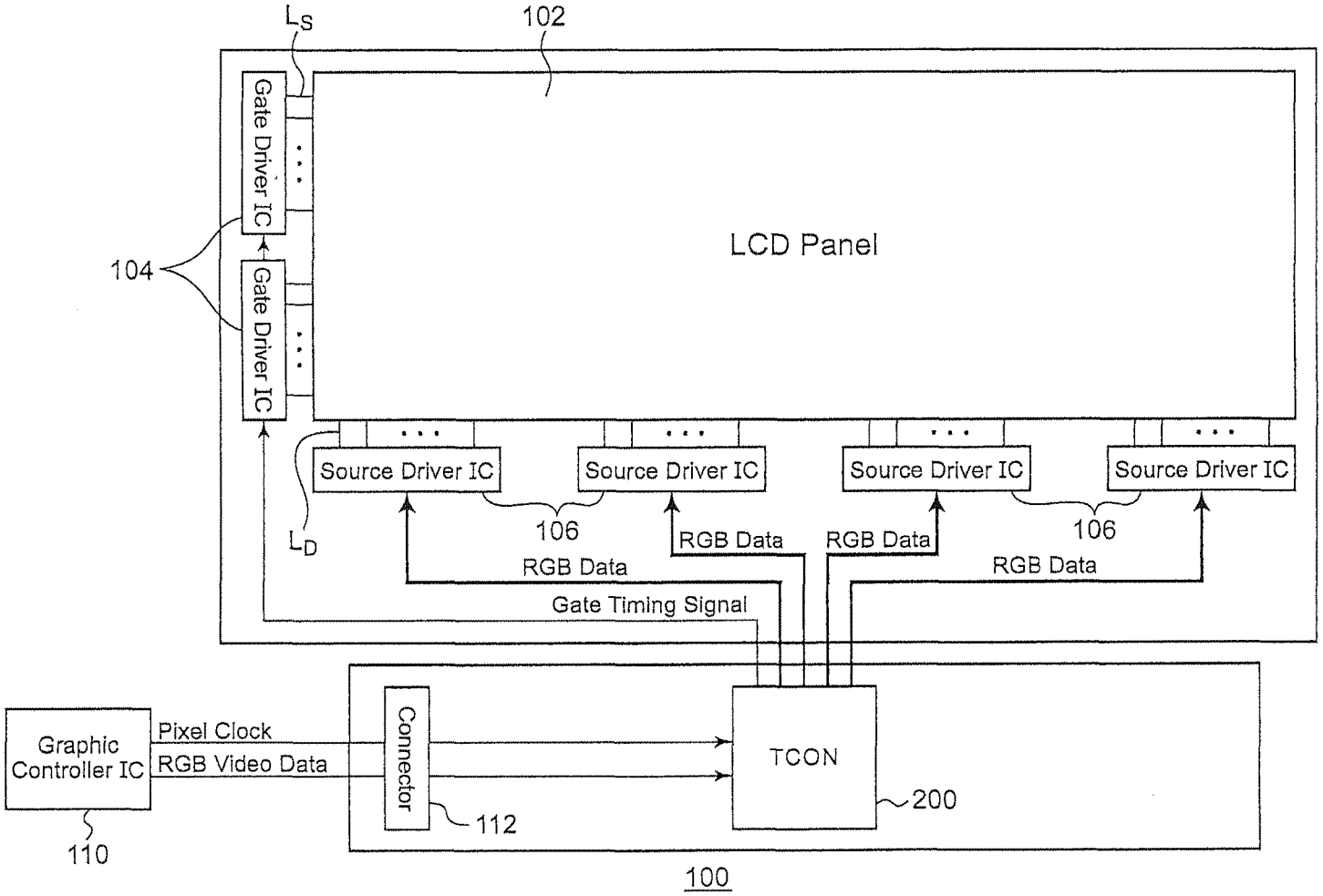
FIG. 1 is block diagram showing an image display system.
Figure 2:
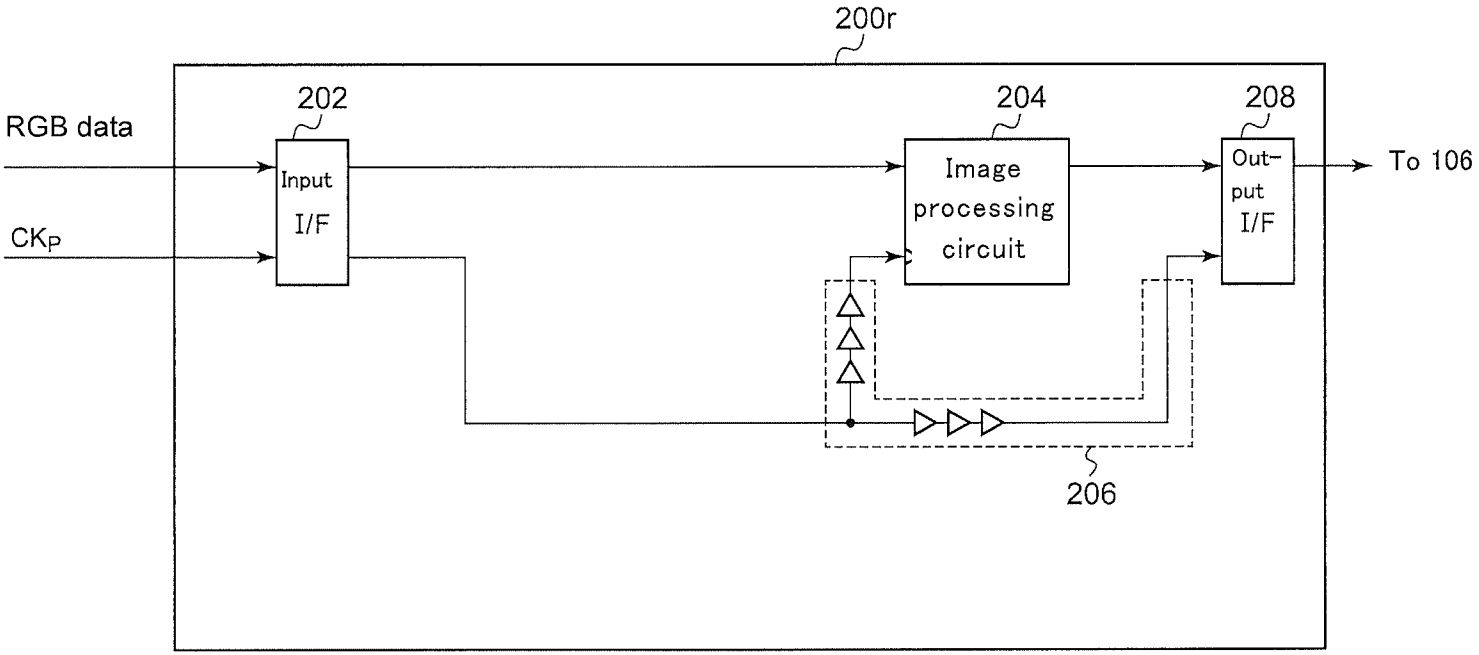
FIG. 2 is a block diagram showing the timing controller in FIG. 1.

In the following descriptions, based on the preferred embodiments, the present invention is illustrated in reference with accompanying figures. The identical or similar elements, members and processing steps are denoted by the same reference numerals, and the repeated descriptions are properly omitted. Further, the embodiments are exemplary but not used for limiting the scope of the present invention. All features and combinations described in the embodiments are not necessarily essential features of the present invention.

In the specification, with the regard to the description, "the status that a member A is connected to a member B", in addition to the situation that the member A is physically and directly connected to the member B, the situation that the member A is connected to the member B through another member, which has no influence on the electrical connection between the member A and the member B, is further included.

Similarly, with regard to the description, "the status that a member C is disposed between the member A and the member B", in addition to the situation that the member A is directly connected to the member C or the member B is directly connected to the member C", the situation that the indirect connection is formed through another member, which has no influence to the electrical connection, is further included.

Figure 3:
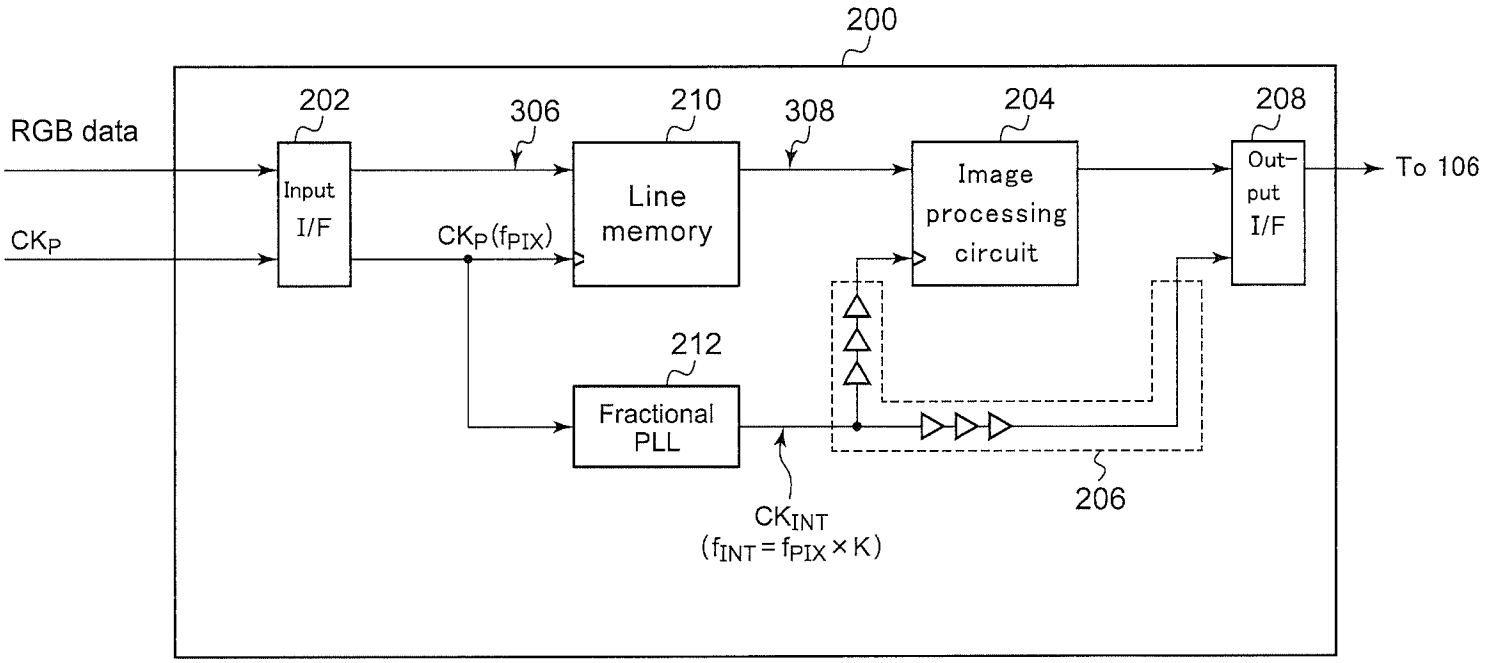
FIG. 3 is a block diagram showing a timing controller according to an embodiment of the present invention.

FIG. 3 is a block diagram showing a timing controller 200 according to one embodiment. The timing controller 200 is used in an image display system 100 shown in FIG. 1 for receiving pixel (RGB) data constituting image data and a pixel clock $CK_P$ accompanying with the pixel data from the graphic controller 110 and outputting to a data driver (not shown). For example, the pixel data are transmitted in a differential serial format.

The timing controller 200 further includes a line memory 210 and a frequency synthesizer 212 in addition to an input interface circuit 202, an image processing circuit 204, a clock tree 206 and an output interface circuit 208. The timing controller 200 is a functional IC (integrated circuit) integrated on a semiconductor substrate.

The line memory 210 includes a capacity for retaining at least pixel data of one horizontal line. The pixel data in a serial format are received by the input interface circuit 202, and are stored successively stored in the line memory 210. The pixel clock $CK_P$ can also be embedded in the pixel data. In this situation, the input interface circuit 202 includes a clock data recovery (CDR) circuit for regenerating the pixel clock $CK_P$.

The pixel clock $CK_P$ received by the input interface circuit 202 is received by the frequency synthesizer 212 for generating an internal pixel clock $CK_{INT}$ with a frequency (an internal frequency) $f_{INT}$, and the frequency $f_{INT}$ is the coefficient K multiplied by the frequency (pixel clock frequency) $f_{PIX}$ of the pixel clock $CK_P$:

$$f_{INT}=K\times f_{PIX}$$

In order to be clearly differentiated from the internal pixel clock $CK_{INT}$, the pixel clock $CK_P$ is also called as an external pixel clock if necessary. K can be more than 1, and also can be smaller than 1. In this embodiment, the situation of K<1 is illustrated.

The internal pixel clock $CK_{INT}$ is provided to the image processing circuit 204 or the output interface circuit 208 through the clock tree 206.

The image processing circuit 204 processes the pixel data stored in the line memory 210 synchronously with the internal pixel clock $CK_{INT}$. The output interface circuit 208 transmits the pixel data processed by the image processing circuit 204 to the source driver 106 synchronously with the internal pixel clock $CK_{INT}$.

The frequency synthesizer 212 can include a fractional PLL (phase locked loop) circuit, and thus the coefficient K is determined as a non-integer (a fraction). Preferably, the frequency division ratio of the fraction PLL circuit is variable.

The basic configuration of the timing controller 200 is described in the above description.

Figure 4A:
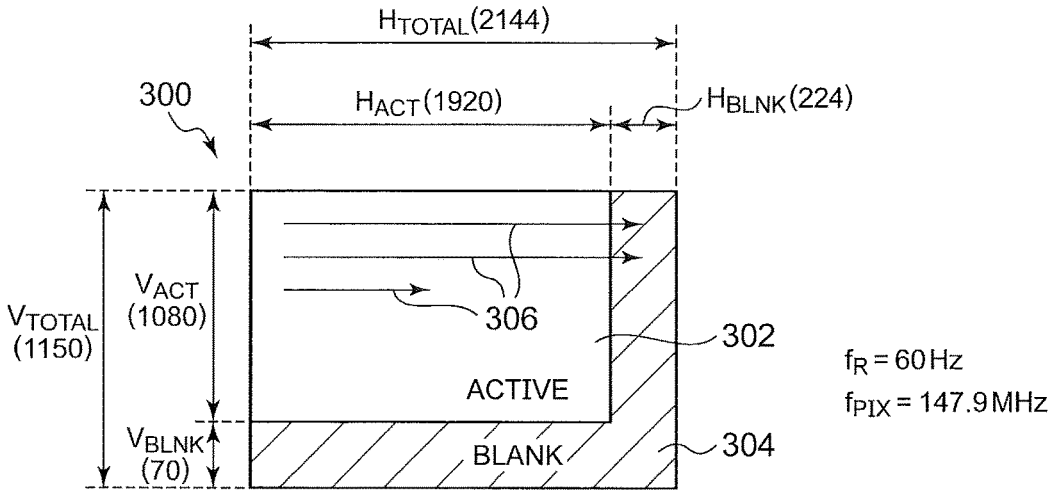
FIG. 4A shows an image of source image data transmitted from the graphic controller.
Figure 4B:
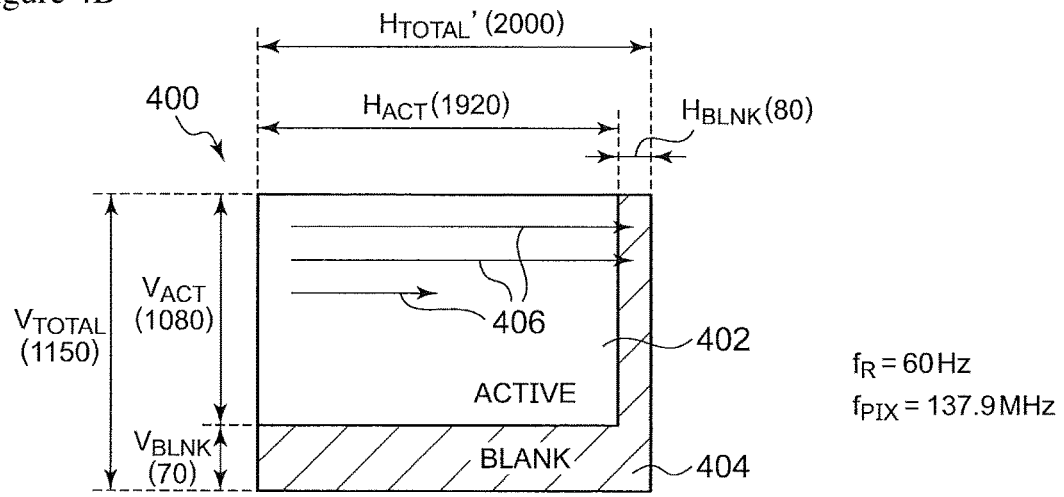
FIG. 4B shows an image of internal image data processed in the image processing circuit.

FIG. 4(*a*) shows an image of a source image data 300 transmitted from the graphic controller 110. The source image data 300 transmitted from the graphic controller 110 include an active area 302 and a blank area (indicated by hatching lines) 304. The active area 302 is corresponding to the significant image data displayed on the display panel 102, and the blank area 304 is inserted outside the active area 302. $H_{ACT}$ is the horizontal resolution (the pixel number) of the active area 302, and $V_{ACT}$ is the vertical resolution (the pixel number) of the active area 302. Further, $V_{TOTAL}$ is the whole vertical resolution (the pixel number) of the source image data 300 including the blank area 304, and $H_{TOTAL}$ is the horizontal resolution of the source image data 300 including the blank area 304. In the full high definition (FHD) quality, $H_{ACT}$=1920 and $V_{ACT}$=1080.

The source image data 300 are transmitted from the graphic controller 110 to the timing controller 200 line by line from the top in order. The image data in each line (line data 306) are transmitted from left to right in order. If we focus on the transmission on each line, the $H_{ACT}$ pieces of effective pixels included in the active area 302 are transmitted, and then inserted into the blank duration corresponding to the $H_{BLANK}$ pieces of pixels. In the blank duration, the data for timing control may also be transmitted. The transmission for one line is repeated by number of line, which is $V_{ACT}$, in the active area. Then, the blank duration is inserted over the line $V_{ACT}$.

It is assumed that $f_{PIX}$ is the frequency (Hz) of the pixel clock $CK_P$, and $f_R$ is the refresh rate (Hz) of the image data. In this situation, the transmission time $T_{FRM}$ of one frame is $$T_{FRM}=1/f_R.$$

In a situation that $f_R$=60 Hz, $T_{FRM}$=16.7 ms. When $V_{BLNK}$=70 and $V_{TOTAL}$=1150, the transmission time $T_{LINE}$ of one line is $$T_{LINE}=16.7\text{ ms}/1150=14.5\ \mu\text{s}.$$

If $H_{BLNK}$=224 and $H_{TOTAL}$=2144, the transmission time ($1/T_{PIX}$) of one pixel is $$T_{PIX}=14.5\ \mu\text{s}/2144=6.76\text{ ns}.$$

Hence, the frequency $f_{PIX}$ of the pixel clock $CK_P$ is $$f_{PIX}=1/T_{PIX}=1/6.76\text{ ns}\approx 147.9\text{ MHz}.$$

$f_R$, $f_{PIX}$, $H_{TOTAL}$, $V_{TOTAL}$, $H_{BLNK}$ and $V_{BLNK}$ are set by the graphic controller 110.

Referring to FIG. 3, the coefficient K is illustrated. In the frequency synthesizer 212, the coefficient K satisfies the following equation (1).

$$T_{LINE}>H_{ACT}/f_{INT}=H_{ACT}/(f_{PIX}\times K) \quad (1)$$

It means that the coefficient K satisfies the following equation.

$$(H_{ACT}/f_{PIX})/T_{LINE}<K<1$$

The transmission time $T_{LINE}$ of image data of one line is given by $1/f_{PIX}\times H_{TOTAL}$. In other words, it can also be understood that the coefficient K satisfies equation (2).

$$H_{ACT}/H_{TOTAL}<K<1 \quad (2)$$

As the above-mentioned, in a situation that $H_{ACT}$=1920, $H_{BLNK}$=224 and $H_{TOTAL}$=2144, K are determined to satisfy 0.895<K<1. In the following, in a situation that K=0.93 and $f_{PIX}$=147 MHz, $f_{INT}\approx$137.9 MHz.

From another point of view, it can also be understood that the coefficient K satisfies equation (3).

$$(1/f_R)/V_{TOTAL}>H_{ACT}/(f_{PIX}\times K) \quad (3)$$

In equation (3), $1/f_R$ is the frame period $T_{FRM}$, and $(1/f_R)/V_{TOTAL}$ at the left side is corresponding to the transmission time $T_{LINE}$ of one line.

The configuration of the timing controller 200 is described in the above descriptions. Then, the operations of the timing controller 200 are illustrated.

Figure 5A:
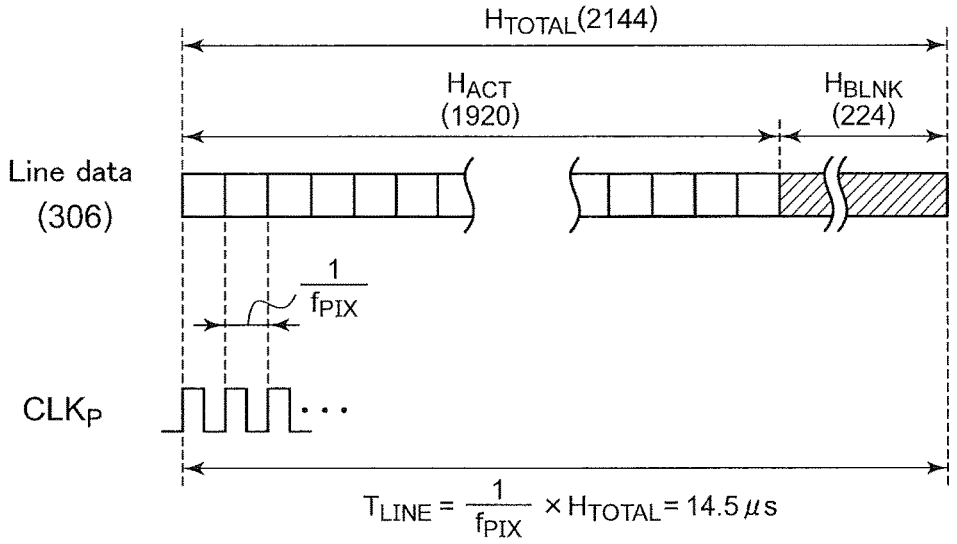
FIG. 5A is a time chart showing the writing operation of line data to a line memory.
Figure 5B:
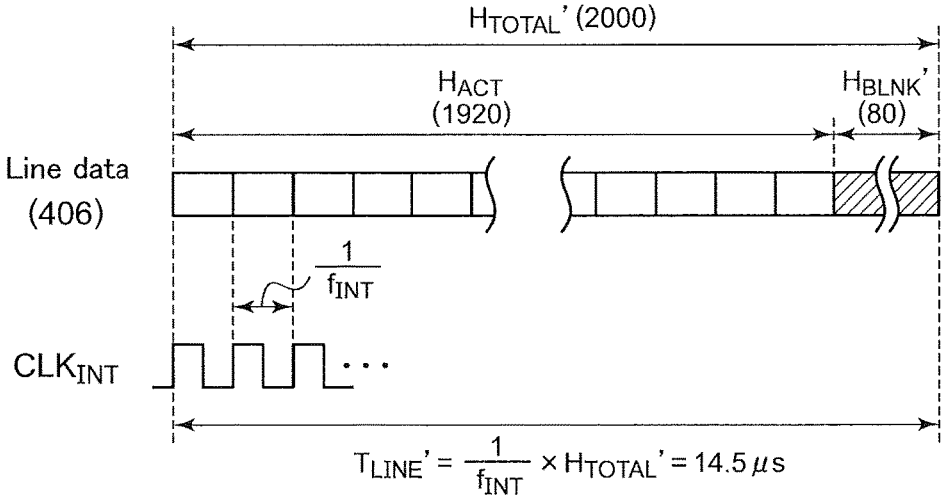
FIG. 5B is a time chart showing line data processed by the image processing circuit.

FIG. 5(*a*) shows a time chart of the writing operation of the line data 306 to the line memory 210, and FIG. 5(*b*) shows a time chart of the line data 406 read out from the line memory 210 and processed by the image processing circuit 204.

As the above-mentioned, the transmission time $T_{LINE}$ of one line data 306 is 2144/147 MHz=14.5 μs. For such line data 306, the image processing circuit 204 perform a processes synchronously with the internal pixel clock $CK_{INT}$ with the frequency, 137.9 MHz, lower than the pixel clock frequency $f_{PIX}$ (−147.9 MHz). Hence, during the transmission time $T_{LINE}$ of one line, the pixel number $H_{TOTAL}'$, which can be processed, is 4.5 μs×137.9 MHz=2000. Therefore, the line data 406 read out from the line memory 210 include the blank area with $H_{BLNK}'=H_{TOTAL}'-H_{ACT}=2000-1920=80$ pixels.

FIG. 4(*b*) shows an image of the internal image data 400 processed in the image processing circuit 204. The internal image data 400 includes an active area 402 and a blank area 404. If FIG. 4(*a*) is compared with FIG. 4(*b*), the active areas 302 and 402 are identical, but the blank areas 304 and 404 are different. For the pixel number $H_{BLNK}$ of the blank area of the line data 306 in the source image data 300 and the pixel number $H_{BLNK}'$ of the blank area of the line data 406 in the internal image data 400, the following equation is established.

$$H_{BLNK}'<H_{BLNK}.$$

The horizontal resolution of the internal image data 400 including the blank area is set as $H_{TOTAL}'$ by the image processing circuit 204 so that the time needed for processing data of one line is the same as the transmission time of one line. In other words, the horizontal resolution $H_{TOTAL}'$ satisfies equation (4).

$$(1/f_{PIX})\times H_{TOTAL}=(1/f_{INT})\times H_{TOTAL}' \quad (4)$$

If equation (4) is modified, equations (5) and (6) are obtained.

$$H_{TOTAL}'=H_{TOTAL}\times f_{INT}/f_{PIX}=H_{TOTAL}\times K \quad (5)$$

$$H_{BLNK}'=H_{TOTAL}'-H_{ACT}=H_{TOTAL}\times K-H_{ACT} \quad (6)$$

In other words, to satisfies equation (6), the pixel number $H_{BLNK}'$ of the horizontal blank duration is adjusted according to the coefficient K so as to generate the internal image data 400.

The operations of the timing controller 200 are illustrated in the above descriptions.

According to the timing controller 200, the frequency $f_{INT}$ of the internal pixel clock $CK_{INT}$ can be freely set. In this embodiment, it is set as K<1, the internal pixel clock $CK_{INT}$, having the frequency lower than the frequency of the external pixel clock $CK_P$, is generated, and by reducing the pixel number $H_{BLNK}$ of the horizontal blank duration, the pixel data of one line are processed without failure.

Since the frequency of the internal pixel clock $CK_{INT}$ transmitted in the clock tree 206 can be lower than the pixel frequency $f_{PIX}$ the power consumption of the clock tree 206 can be reduced. Further, the image processing circuit 204 and the output interface circuit 208 are operated synchronously with the internal pixel clock $CK_{INT}$, and thus their power consumption can also be reduced.

In the above descriptions, the present invention is illustrated according to the embodiments. However, the above embodiments are exemplary, and there may be any variations in each element, each process or the combination thereof. The variations are illustrated in the following descriptions.

(The First Variation)

Figure 6:
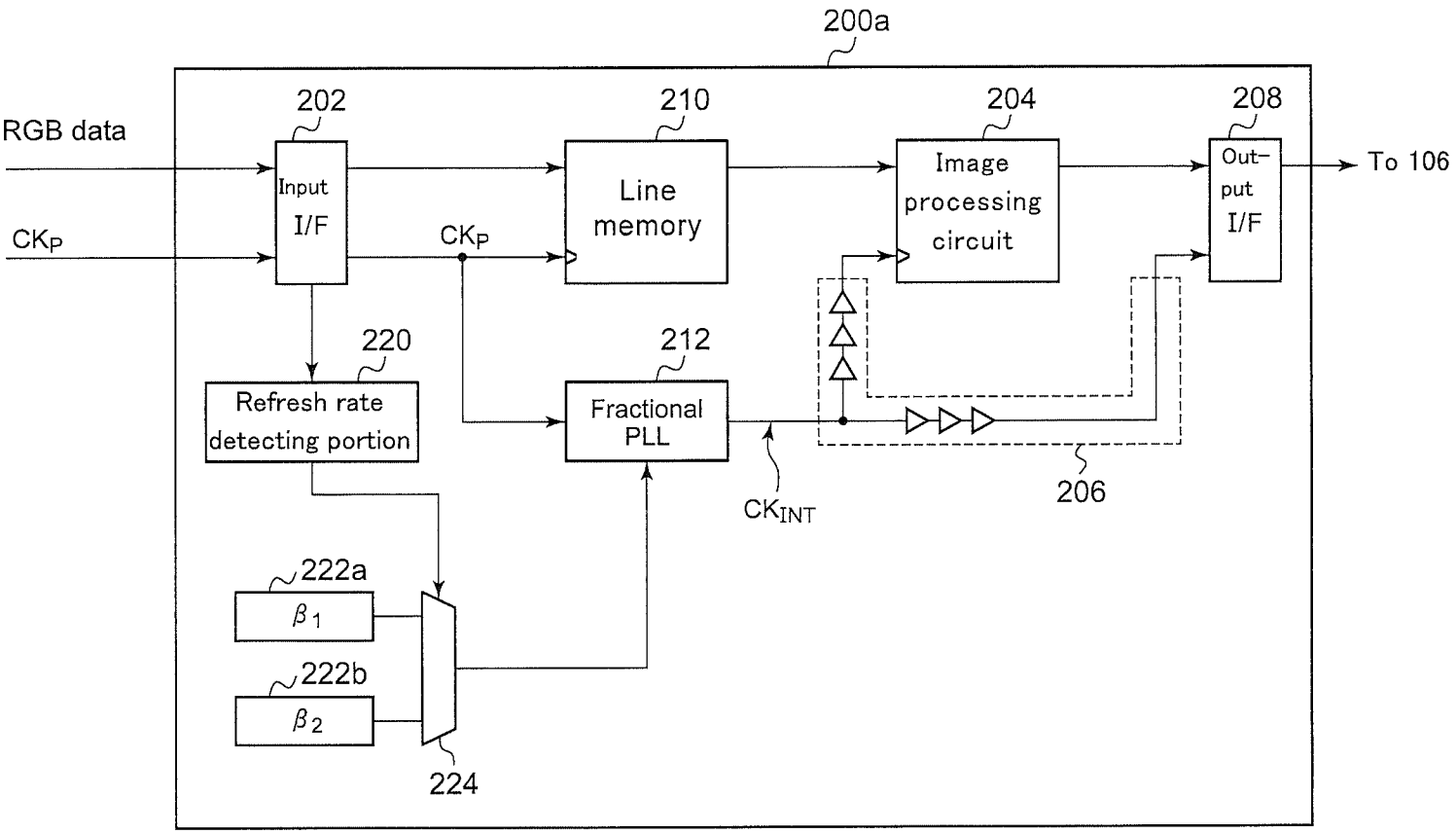
FIG. 6 is a block diagram showing a timing controller according to the first variation.

FIG. 6 is a block diagram showing a timing controller 200*a* according to the first variation. In this variation, a graphic controller 110 can change a refresh rate $f_R$ of image data 300. For example, the refresh rate is set as a first refresh rate in a dynamic image (for example, 60 Hz), and is set as a second refresh rate (for example, 40 Hz) in a static image.

A refresh rate detecting portion 220 detects the refresh rate $f_R$. The refresh rate detecting portion 220 also can detects the refresh rate based on a control signal directly or indirectly showing the refresh rate transmitted from the graphic controller 110 to the timing controller 200*a*. For example, the timing controller 200*a* can include a register (not shown) for retaining setting data indicating the refresh rate, and the setting data are written into the register by the graphic controller 110. Alternatively, the refresh rate detecting portion 220 can detect the refresh rate by monitoring the source image data 300.

In the timing controller 200*a*, the coefficients K for setting the internal frequency $f_{INT}$ are determined for each refresh rate. In other words, there are a coefficient $K_1$ corresponding to a first refresh rate (60 H) and a coefficient $K_2$ corresponding to a second refresh rate (40 Hz), and thus the coefficient can be selected for the internal frequency $f_{INT}$.

The setting data $\beta_1$ of the frequency division ratio corresponding to the first coefficient $K_1$ are retained in the register 222*a*, and the setting data $\beta_2$ of the frequency division ratio corresponding to the second coefficient K2 are retained in the register 222*b*.

The frequency synthesizer 212 is a fractional PLL (phase locked loop) circuit, and its frequency division ratio is variable. A selector 224 selects one of the setting data $\beta_1$ and $\beta_2$ according to the detection result from the refresh rate detecting portion 220, and determines the frequency division ratio of the frequency synthesizer 212 is.

The configuration of the timing controller 200*a* is described in the above descriptions. Then, the operations of the timing controller 200*a* are illustrated.

With regard to the first refresh rate, it is like the illustration for setting $K_1=0.93$ in reference with FIGS. 4(*a*) and 4(*b*).

Figure 7A:
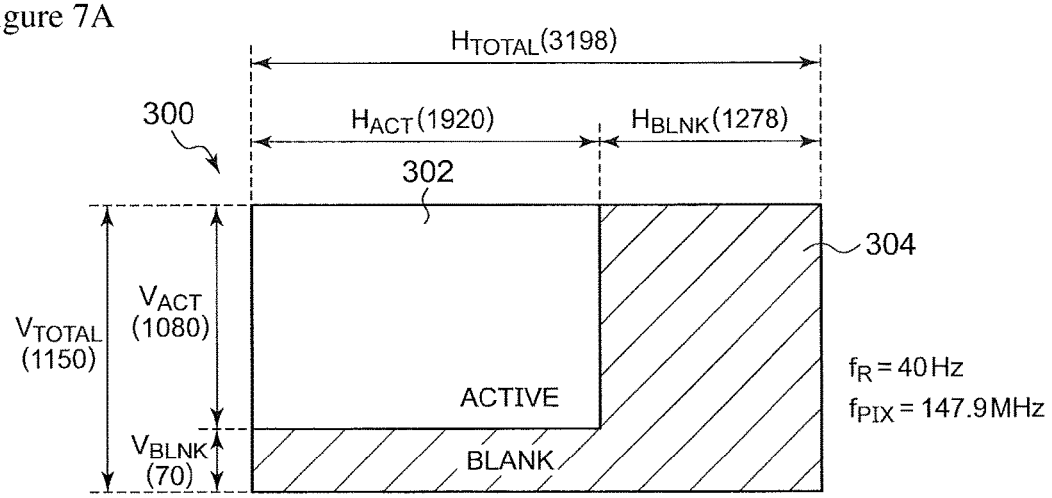
FIG. 7A shows an image of source image data transmitted from the graphic controller with the second refresh rate.
Figure 7B:
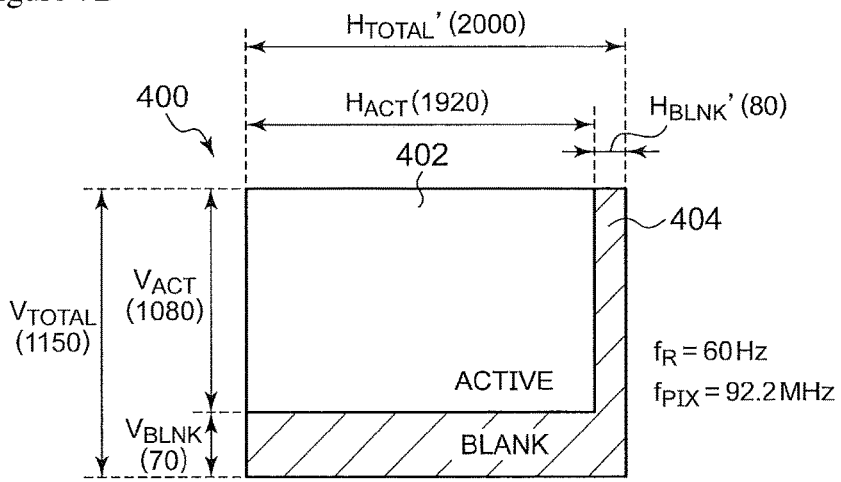
FIG. 7B shows an image of internal image data processed by the image processing circuit.

FIG. 7(*a*) shows an image of the source image data 300 transmitted from the graphic controller 110 with the second refresh rate, and FIG. 7(*b*) shows an image of the internal image data 400 processed in the image processing circuit 204.

Referring to FIG. 7(*a*), the source image data 300 are illustrated. When the refresh rate is $f_R$=40 Hz, the frame period $T_{FRM}$ is 1/40=25 ms, and the transmission time $T_{LINE}$ of pixel data of one line is $T_{LINE}=T_{FRM}/V_{TOTAL}$=25 ms/1150=21.7 μs. The pixel frequency $f_{PIX}$ is 147.9 MHz, the total pixel number $H_{TOTAL}$ of one line is $H_{TOTAL}$=3198 pixels, and the pixel number $H_{BLNK}'$ of the horizontal blank duration is 3198−1920=1278 pixels.

Referring to FIG. 7(*b*), the internal image data 400 are illustrated. $K_2$ is 0.62, and $f_{INT}$ is 92.2 MHz. The total pixel $H_{TOTAL}'$ of one line of the internal image data 400 is 2000 pixels, and its transmission time $T_{LINE}$ is 2000×1/92.2

MHz=21.7 μs, which is the same as the transmission time of one line of the source image data 300.

Figure 8:
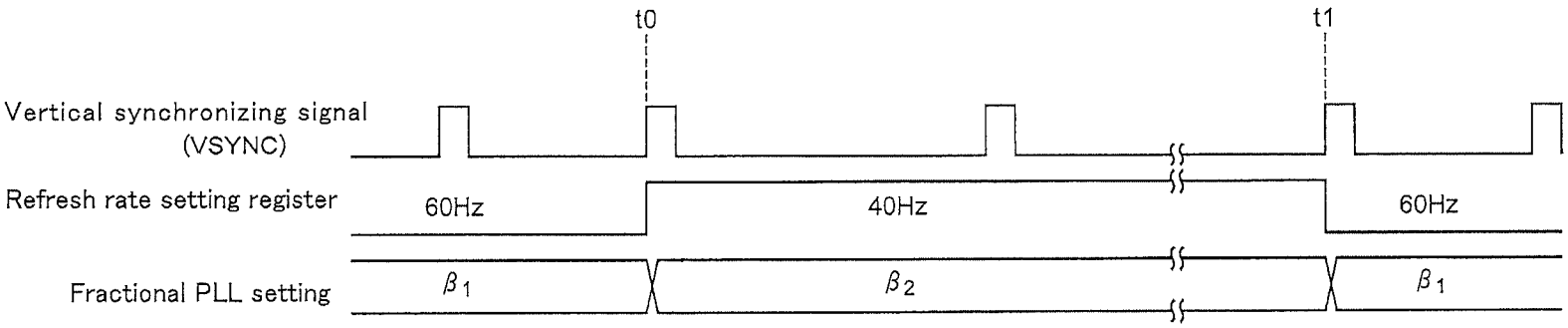
FIG. 8 is a time chart showing the switching operation of refresh rates.

FIG. 8 is a time chart showing the switching operation of the refresh rate. Before time t0, the data indicating the first refresh rate (60 Hz) are written into the register, the first setting data $\beta_1$ are selected, and thus the image processing circuit 204 and the output interface circuit 208 operates with the first internal frequency $f_{INT1}$, 137.9 MHz.

At time t0, the graphic controller 110 is switched to the second refresh rate (40 Hz), and the data indicating the second refresh rate are written to the register. In response to the writing operation, the second setting data $\beta_2$ are selected, and thus the image processing circuit 204 and the output interface circuit 208 operate with the second frequency $f_{INT2}$, 92.2 MHz, such that the power consumption is reduced.

At time t1, the graphic controller 110 is restored to the first refresh rate (60 Hz), and the data indicating the first refresh rate are written into the register. In response to the writing operation, the first setting data $\beta_1$ are selected, and thus the image processing circuit 204 and the output interface circuit 208 operate with the first internal frequency $f_{INT1}$.

Therefore, in accordance with the timing controller 200*a* of the first variation, on the platform that the refresh rate of the source image data 300 from the graphic controller 110 is variable, the internal frequency $f_{INT}$ is switched according to the refresh rate so as to reduce power consumption.

(The Second Variation)

Figure 9:
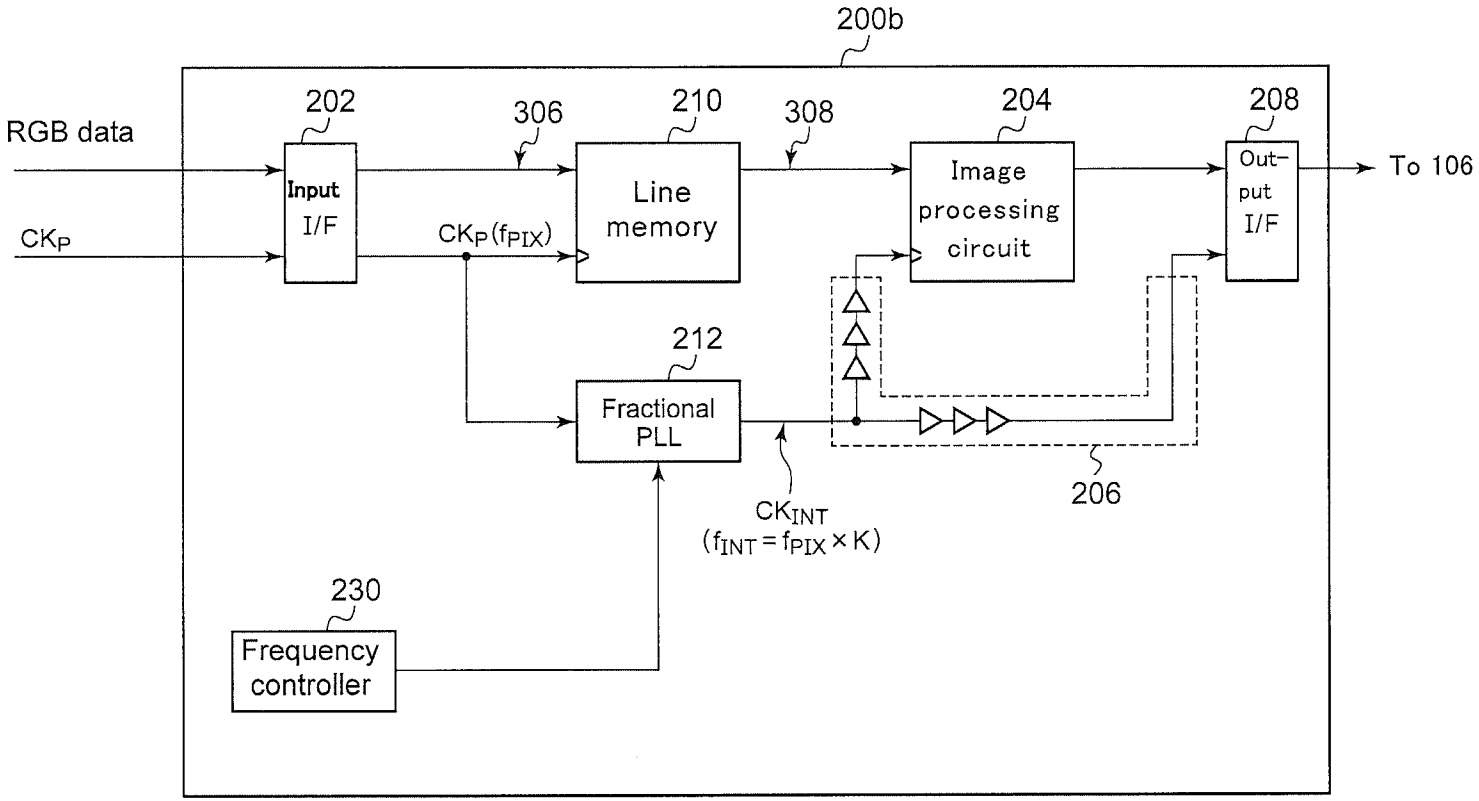
FIG. 9 is a block diagram showing a timing controller according to the second variation.

FIG. 9 is a block diagram showing a timing controller 200*b* according to the second variation. The timing controller 200*b* includes a frequency controller 230. The coefficient K, that is the frequency division ratio of the frequency synthesizer 212, in other words, the internal frequency $f_{INT}$ is dynamically or statically controlled by the frequency controller 230 according to the status of the source image data 300 and/or the apparatus carrying the timing controller 200*b*.

The term "status of the source image data" includes (i) the refresh rate of the source image data, (ii) the pixel frequency $f_{PIX}$ of the source image data, etc. The term "status of the apparatus carrying the timing controller 200*b*" includes a voltage of a battery carried on the apparatus, a command from an external micro-computer, etc. For example, when the voltage of the battery is decreased, by reducing the internal frequency, the power consumption can be lowered and the operating time can be extended.

In addition, it can be understood that the refresh rate detecting portion 220, the register 222 and the selector 224 in FIG. 6 are corresponding to the members of the frequency controller 230 in FIG. 9.

(The Third Variation)

In this embodiment, in a situation that K<1 and thus the power consumption is reduced is illustrated. However, it may also be that K>1 and the internal frequency $f_{INT}$ is higher than the frequency $f_{PIX}$ of the pixel clock. As an example, the coefficient K can also be determined so that $f_{INT}=f_{PIX}\times K$ is inconsistent with the frequency spectrum for wireless communication. If the frequency used in wireless wide area network (WWAN) or wireless local area network (WLAN) is interfered by the internal frequency $f_{INT}$, the error rate of the wireless communication becomes high, which is not preferable. In this situation, by setting K as a large value to increase the internal frequency $f_{INT}$, the interference on the frequency can be prevented. In the situation of K>1, the pixel number $H_{BLNK}'$ of the horizontal blank duration of the internal image data 400 is more than the pixel number $H_{BLNK}$ of the horizontal blank duration of the source image data 300.

(The Fourth Variation)

The timing controller can also include a frame memory capable of retaining pixel data of one frame of the source image data 300 to replace the line memory 210. In this situation, the processing similar to that in the embodiment can be performed.

Alternatively, the following operations can be performed.

When $f_{PIX}$ (Hz) is the frequency of the pixel clock, $f_R$ (Hz) is the refresh rate of the image data, $H_{TOTAL}$ is the horizontal resolution of the source image data including the blank area, and $V_{ACT}$ is the vertical resolution of the active area, K<1 satisfies $(1/f_R)/H_{TOTAL}>V_{ACT}/(f_{PIX}\times K)$.

Then, the pixel number $V_{BLNK}$ of the vertical blank duration is properly reduced to maintain the processing time for one longitudinal column, such that the internal frequency $f_{INT}=f_{PIX}\times K$ can be reduced, and the power consumption can be reduced.

Alternatively, the following operations can be performed.

$$(1/f_R)/(H_{ACT}\times V_{ACT})>1/(f_{PIX}\times K)$$

In this situation, the pixel numbers of the vertical blank duration $V_{BLNK}$ and the horizontal blank duration $H_{BLNK}$ are properly reduced to maintain the processing time in one frame, such that the frequency $f_{INT}$ of the internal pixel clock $CK_{INT}$ is reduced, and the power consumption is reduced.

At last, the use of the timing controller is illustrated.

Figure 10:
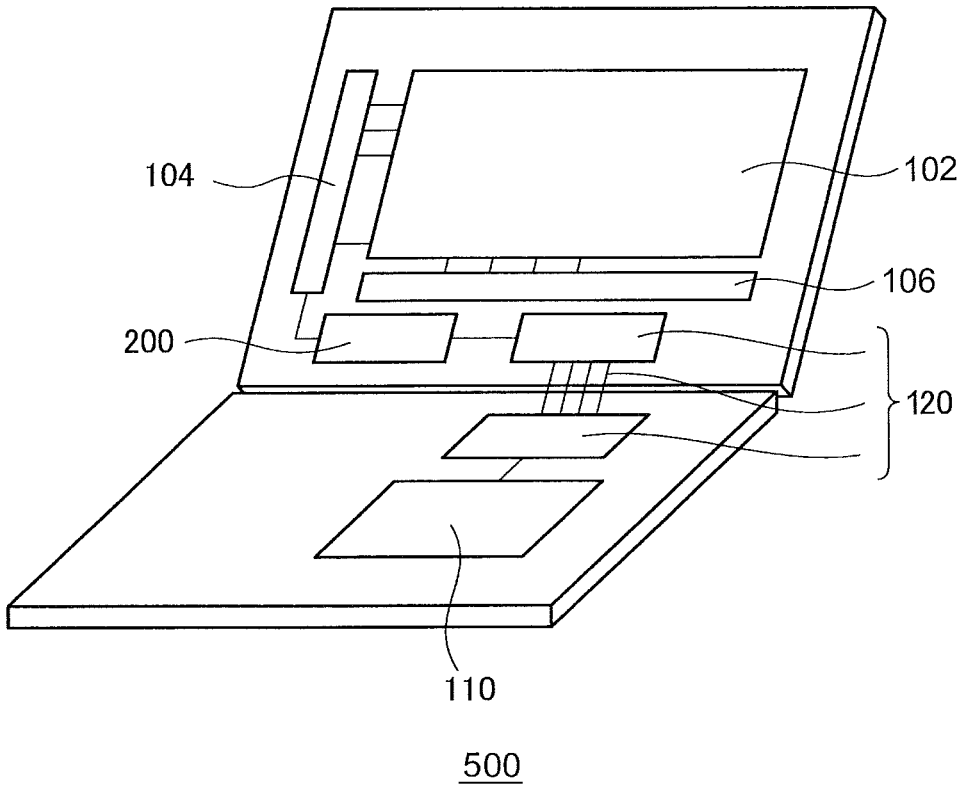
FIG. 10 is a perspective view showing an electronic apparatus.

FIG. 10 is perspective view showing an electronic apparatus. The electronic apparatus 500 of FIG. 10 can be a notebook PC (personal computer), a tablet terminal, a smart phone, a portable game device, a audio player, etc. The electronic apparatus 500 includes a graphic controller 110, a display panel 102, a gate driver 104 and a source driver 106 disposed in a casing 502. A transmission device 120 including a differential transmitter, a transmission path and a differential receiver can also be disposed between the timing controller 200 and the graphic controller 110.

According to the embodiments, the present invention is illustrated by using specific statements, but the embodiments only present the principle and applications of the present invention. For the embodiments, many variations and changes of the configurations are admitted without departing the spirit and scope of the present invention.

What is claimed is:

1. A timing controller, configured to receive pixel data constituting image data and an external pixel clock accompanying with the pixel data from a graphic controller and output to a data driver, and comprising:

a line memory, capable of retaining at least the pixel data of one line;

an input interface circuit, for receiving the pixel data and storing the pixel data in the line memory;

a frequency synthesizer, for receiving the external pixel clock received by the input interface circuit and generating an internal pixel clock having a frequency being a coefficient K (K is a real number) multiplied by a frequency of the external pixel clock;

an image processing circuit, for processing the pixel data stored in the line memory synchronously with the internal pixel clock;

wherein the image processing circuit receives the internal pixel clock from the frequency synthesizer; and an output interface circuit, for transmitting the pixel data processed by the image processing circuit to a source driver synchronously with the internal pixel clock.

2. The timing controller according to claim 1, wherein $H_{ACT}$ is a horizontal resolution of an active area of the image data, $f_{PIX}$ is a frequency (Hz) of the external pixel clock and $T_{LINE}$ is a transmission time (s) for pixel data of one line, wherein the coefficient K satisfies the following equation (1):

$$T_{LINE} > H_{ACT}/(f_{PIX} \times K) \quad (1).$$

3. The timing controller according to claim 1, wherein $H_{ACT}$ is a horizontal resolution of an active area of the image data and $H_{TOTAL}$ is a horizontal resolution of the image data including the blank area and a blank area, wherein the coefficient K satisfies the following equation (2):

$$H_{ACT}/H_{TOTAL} < K \quad (2).$$

4. The timing controller according to claim 1, wherein $f_{PIX}$ is a frequency (Hz) of the external pixel clock, $f_R$ is a refresh rate (Hz) of the image data, $V_{TOTAL}$ is a vertical resolution of the image data including an active area and a blank area and $H_{ACT}$ is a horizontal resolution of the active area, wherein the coefficient K satisfies the following equation (3):

$$(1/f_R)/V_{TOTAL} > H_{ACT}/(f_{PIX} \times K) \quad (3).$$

5. The timing controller according to claim 1, wherein the graphic controller is capable of changing the refresh rate of the image data graphic controller, and the coefficient K is determined for each refresh rate.

6. The timing controller according to claim 5, further comprising a detector for detecting a change of the refresh rate.

7. The timing controller according to claim 1, further comprising a frequency controller for dynamically controlling the coefficient K according to a status of the image data and/or a status of an apparatus carrying the timing controller.

8. The timing controller according to claim 1, wherein K>1.

9. The timing controller according to claim 1, wherein the coefficient K is determined so that $f_{PIX} \times K$ is inconsistent with a frequency spectrum for wireless communication.

10. The timing controller according to claim 1, wherein the frequency synthesizer includes a fractional PLL (phase locked loop) circuit.

11. The timing controller according to claim 10, wherein a frequency division ratio of the fractional PLL circuit is variable.

12. The timing controller according to claim 1, which is integrated on a semiconductor substrate.

13. An electronic apparatus, comprising the timing controller of claim 1.

14. An image data processing method, comprising steps of:

receiving pixel data constituting image data and an external pixel clock accompanying with the pixel data from a graphic controller;

receiving the pixel data and storing the pixel data in a line memory capable of retaining at least the pixel data of one line;

transmitting the external pixel clock to a frequency synthesizer;

generating an internal pixel clock by the frequency synthesizer, wherein the internal pixel clock has a frequency being a coefficient K (K is a real number) multiplied by a frequency of the external pixel clock;

transmitting the internal pixel clock from the frequency synthesizer to an image processing circuit;

processing the pixel data stored in the line memory by the image processing circuit synchronously with the internal pixel clock; and transmitting the processed pixel data to a source driver synchronously with the internal pixel clock.

15. A timing controller, configured to receive pixel data constituting image data and an external pixel clock accompanying with the pixel data from a graphic controller and output to a data driver, and comprising:

a frame memory capable of retaining the pixel data of one frame;

an input interface circuit for receiving the pixel data and storing the pixel data in the frame memory;

a frequency synthesizer for receiving the external pixel clock received by the input interface circuit and generating an internal pixel clock having a frequency being a coefficient K (K is a real number) multiplied by a frequency of the external pixel clock;

an image processing circuit for processing the pixel data stored in the frame memory synchronously with the internal pixel clock;

wherein the image processing circuit receives the internal pixel clock from the frequency synthesizer; and an output interface circuit for transmitting the pixel data processed by the image processing circuit to a source driver synchronously with the internal pixel clock, wherein $f_{PIX}$ is a frequency (Hz) of the external pixel clock, $f_R$ is a refresh rate (Hz) of the image data, $H_{TOTAL}$ is a horizontal resolution of the image data including an active area and a blank area and $V_{ACT}$ is a vertical resolution of the active area, wherein K<1 satisfies $(1/f_R)/H_{TOTAL} > V_{ACT}/(f_{PIX} \times K)$.

16. A timing controller, configured to receive pixel data constituting image data and an external pixel clock accompanying with the pixel data from a graphic controller and output to a data driver, and comprising:

a frame memory, capable of retaining the pixel data of one frame;

an input interface circuit for receiving the pixel data and storing the pixel data in the frame memory;

a frequency synthesizer for receiving the external pixel clock received by the input interface circuit and generating an internal pixel clock having a frequency being a coefficient K (K is a real number) multiplied by a frequency of the external pixel clock;

an image processing circuit for processing the pixel data stored in the frame memory synchronously with the internal pixel clock;

wherein the image processing circuit receives the internal pixel clock from the frequency synthesizer; and an output interface circuit for transmitting the pixel data processed by the image processing circuit to a source driver synchronously with the internal pixel clock, wherein $f_{PIX}$ is a frequency (Hz) of the external pixel clock, $f_R$ (Hz) is an refresh rate (Hz) of the image data, $H_{ACT}$ is a horizontal resolution including an active area and $V_{ACT}$ is a vertical resolution of an active area, wherein K<1 satisfies $(1/f_R)/(H_{ACT}\ V_{ACT}) > 1/(f_{PIX} \times K)$.

* * * * *